United States Patent [19]

Bringer

[11] 3,948,148

[45] Apr. 6, 1976

[54] DEVICES FOR CONTROLLING PNEUMATIC ACTUATORS

[75] Inventor: Heinz Bringer, Vernon (Eure), France

[73] Assignee: Etat Francais, France

[22] Filed: Apr. 16, 1965

[21] Appl. No.: 450,248

[30] Foreign Application Priority Data

Apr. 16, 1964 France ..... 64.971089

[52] U.S. Cl. ..... 91/461; 91/49

[51] Int. Cl.² ..... F15B 11/08

[58] Field of Search ..... 91/47, 51, 52, 431, 461, 91/414, 304, 49, 459, 307; 60/53 B

[56] References Cited

UNITED STATES PATENTS 3,234,857 2/1966 Castelet ..... 94/461

*Primary Examiner*—Samuel Feinberg
*Attorney, Agent, or Firm*—Robert E. Burns; Emmanuel J. Lobato; Bruce L. Adams

EXEMPLARY CLAIM

1. A device for controlling a pneumatic actuator comprising a working piston, a working chamber in which a pressure varying as a function of the effort to be exerted by said working piston is to be produced, a body, a cylindrical bore formed in said body, a regulating piston slidably fitted in said cylindrical bore, a rod rigid with said piston which emerges from said bore, an adjustment chamber and an amplifying chamber formed in said cylindrical bore on either side of said regulating piston, said adjustment chamber communicating with said working chamber, an inlet chamber formed in said body, a source of compressed gas delivering said gas under a constant pressure, said source being connected permanently to said inlet chamber, a first orifice connecting said inlet chamber to said adjustment chamber, a valve member carried by the rod of said regulating piston and closing said first orifice, another orifice of relatively small cross-sectional area connecting said amplifying chamber to said source of compressed gas, a third orifice having a greater cross-sectional area than said second orifice which connects said amplifying chamber to the surrounding atmosphere, a valve member adapted to obturate said third orifice and a control device acting upon said valve member in order to vary the free cross-sectional passage area of said third outlet orifice and to adjust in proportion thereto the pressure prevailing in said amplifying chamber and, therefore, the pressure in said adjustment chamber and in the working chamber of said pneumatic actuator.

5 Claims, 2 Drawing Figures

DEVICES FOR CONTROLLING PNEUMATIC ACTUATORS

Figure 1:
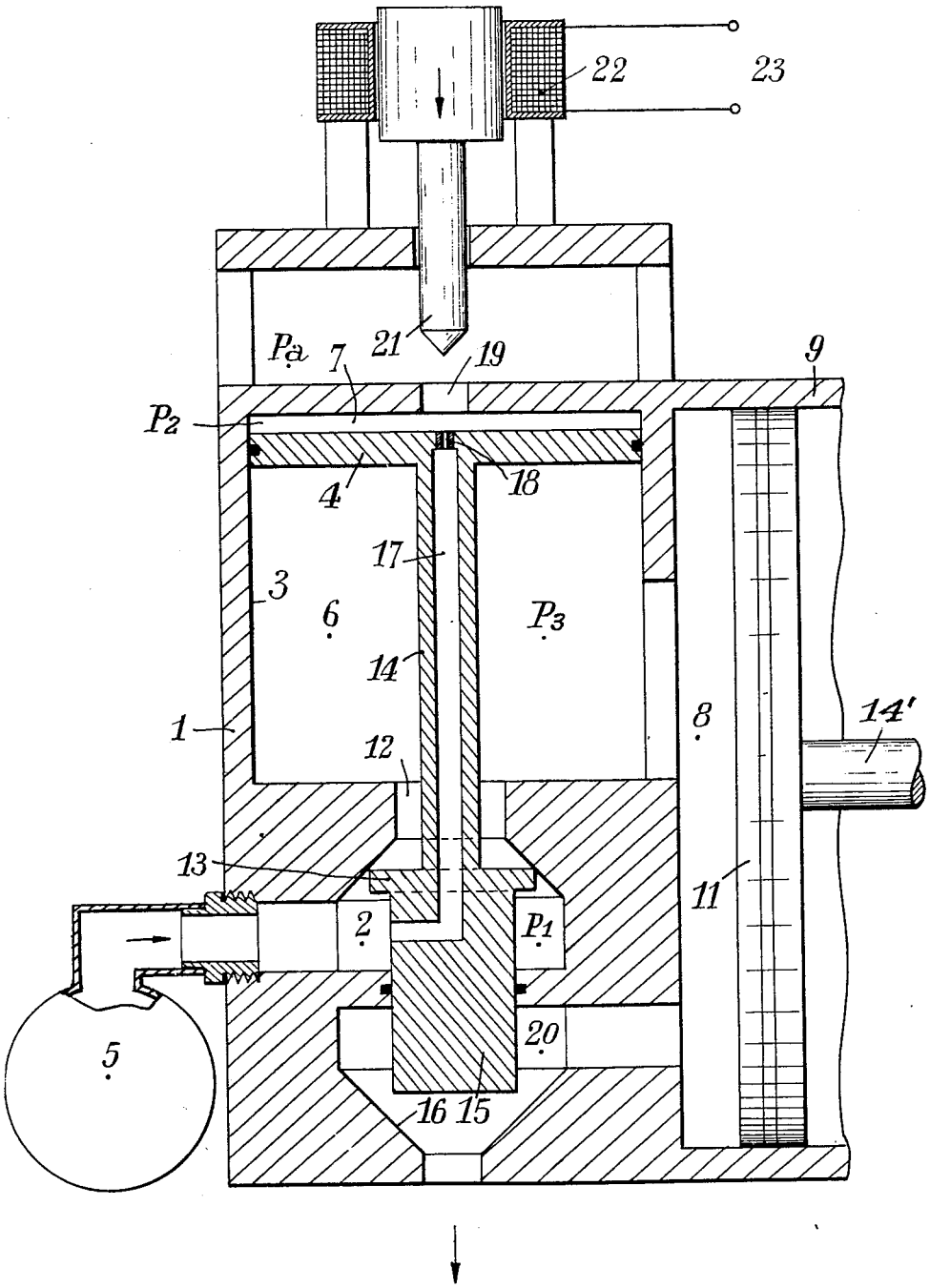

The present invention relates to pneumatic actuators such as pneumatic jacks or like cylinders and has specific reference to a device for controlling a pneumatic actuator comprising a working piston and an operating chamber in which a pressure variable as a function of the force to be applied by the piston is to be produced, this control device being characterized in that it comprises, within a cylinder body, an inlet chamber constantly connected to a source of compressed constant-pressure gas and through the intermediary of a valve member to an adjustment chamber communicating with the operating chamber of the pneumatic actuator, said valve member controlling the communication between said inlet chamber and said adjustment chamber and being rigid with the rod of a regulating piston movable in a cylindrical bore formed in said cylinder body, said piston dividing said bore into the aforesaid adjustment chamber and an amplifying chamber, in that said amplifying chamber is connected on the one hand to a source of gas under pressure through a first orifice of reduced cross-sectional area and, on the other hand, to the surrounding atmosphere through another orifice having a cross-sectional area somewhat greater than that of said first orifice, and that registering with said other orifice is another valve member responsive to a control member to permit the adjustment of the free cross-sectional passage area of said other orifice and therefore of the monitoring pressure produced in said amplifying chamber and consequently in said working chamber of the pneumatic actuator.

The control device according to this invention may be used notably for actuating the directional controls operated by the ejection or exhaust gases of a ram-jet or a turbojet, or for actuating the ejector proper of a jet or rocket.

It permits of exerting a considerable effort on the working piston while requiring but a very moderate effort for moving the valve member.

Figure 2:
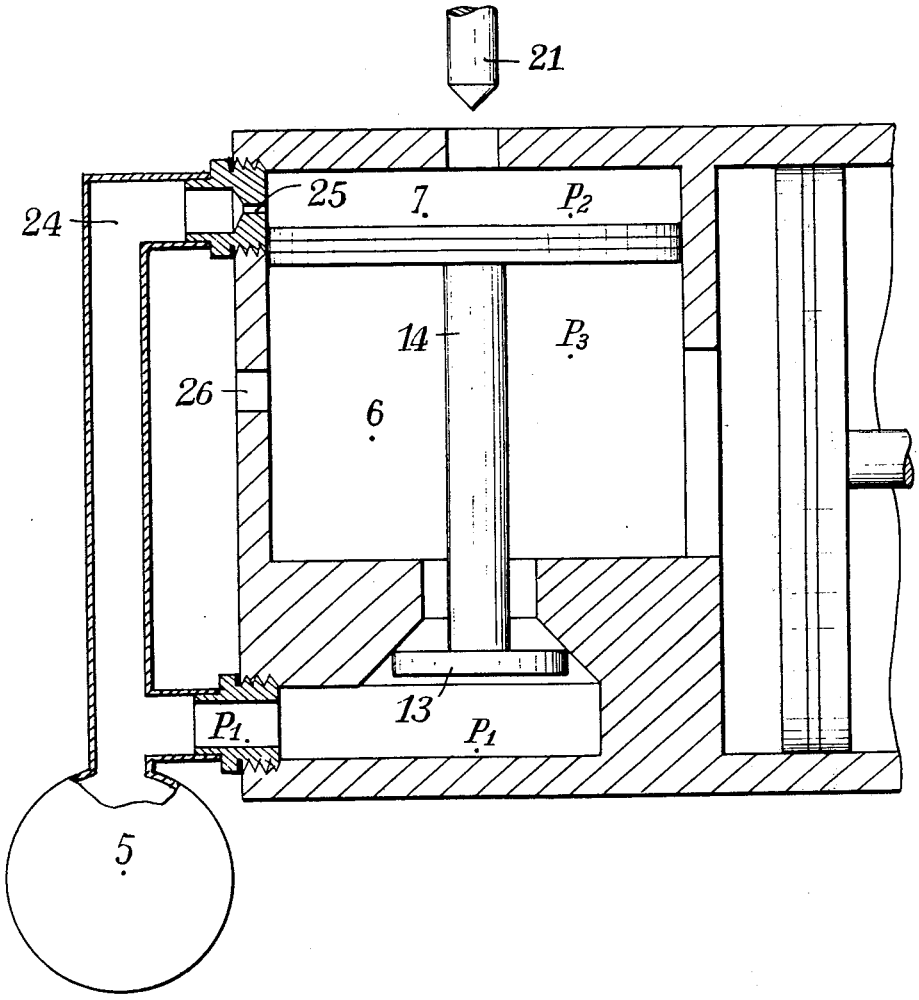

In order to afford a clearer understanding of this invention and of the manner in which the same may be carried out in practice, reference will now be made to the accompanying drawings illustrating diagrammatically by way of example two preferred forms of embodiment of the invention. In the drawings:

FIG. 1 is a longitudinal diagrammatic section showing a pneumatic actuator control device; and FIG. 2 is a longitudinal diagrammatic section showing an alternate form of embodiment of this device.

Referring first to FIG. 1 of the drawings, the device according to the invention illustrated therein comprises a body 1 in which an inlet chamber 2 and a cylindrical bore 3 are formed, a regulating piston 4 being slidably fitted in said bore 3. The inlet chamber 2 communicates with a source of compressed gas 5 delivered under a constant pressure $P_1$.

The regulating piston 4 divides said cylindrical bore 3 into an adjustment chamber 6 and an amplifying chamber 7. The adjustment chamber 6 is directly connected to the expansion or working chamber 8 of the pneumatic actuator proper 9.

This pneumatic actuator comprises a working piston 11 having its rod 14' connected to the member to be controlled thereby, for example a directional control of a ram-jet or a turbojet (not shown).

The adjustment chamber 6 communicates with the inlet chamber 2 through an orifice 12 adapted to be closed by a valve member 13. This valve member 13 is rigid with the rod 14 of the regulating piston 4. The valve member 13, in this specific form of embodiment of the invention, has an extension in the form of another cylindrical valve member 15 adapted to close the exhaust orifice 16 communicating on the one side with the surrounding atmosphere and on the other side with the exhaust chamber 20 connected in turn to the working chamber 8 of the pneumatic actuator 9.

The amplifying chamber 7 communicates with the inlet chamber 2 through the medium of a longitudinal passage 17 extending through the rod 14 of regulating piston 4. This passage 17 opens at its opposite end into the amplifying chamber 7 through a gauged orifice 18 of relatively reduced cross-sectional passage area. On the other hand, the amplifying chamber 7 communicates with the surrounding atmosphere through an outlet orifice 19 registering with a needle valve 21 responsive to a control device 22 consisting for example of an electromotor associated with a mechanical transmission device, or of an electromagnet having its plunger connected to the needle valve 21 as illustrated diagrammatically in FIG. 1.

The control device 22 is connected to terminals 23 to which an electric signal or pulse is applied for controlling the pneumatic actuator.

The device of this invention operates as follows:

When no signal or pulse is applied to the control device 22, the needle valve 21 is spaced from the outlet orifice 19, as shown in FIG. 1. Under these conditions the gas under pressure from the source 5 penetrates through the passage 17 and orifice 18 into the amplifying chamber 7 and then escapes to the surrounding atmosphere through the fully open outlet orifice 19. The pressure $P_2$ prevailing in the amplifying chamber 7 is slightly higher than the atmospheric pressure $P_a$. The valve member 13 is seated and the pressure $P_3$ obtaining in the adjustment chamber 6 and working chamber 8 is equal to the atmospheric pressure since the exhaust orifice 16 is open.

If an electric signal or pulse is applied to the terminals 23, the electromagnet 22 moves the plunger 21 in the direction to close wholly or partly the orifice 19, according to the amplitude of said signal or pulse and therefore as a function of the force exerted on the needle valve 21. Due to the throttling of the outlet orifice 19 the pressure $P_2$ in the amplifying chamber 7 increases and this monitoring pressure varies automatically as a function of the effort exerted on the needle valve 21. The regulating piston 4 to which this monitoring pressure $P_2$ is applied will then unseat the valve member 13, thus permitting the flow of compressed gas from the inlet chamber 2 to the adjustment chamber 6 through the orifice 12. At the same time the opposite valve member 15 closes wholly or partly the outlet orifice 16.

If the force exerted by the pressure $P_3$ on the piston 4 exceeds the force exerted by the monitoring pressure $P_2$, the regulating piston 4 is moved away from the outlet orifice 19 and finally assumes a position of equilibrium such that the ratio of the cross-sectional area of the inlet orifice 18 and outlet orifice 19 of amplifying chamber 7 permits of exerting a working pressure $P_3$ such that the force applied thereby on the piston 4 is equal and opposite to that exerted by the monitoring pressure $P_2$.

The difference obtaining between the two pressures $P_2$ and $P_3$ is immaterial and depends on the shape of the piston 4.

The working pressure $P_3$ may vary from the atmospheric value $P_a$ and the inlet pressure $P_1$. If $P_3$ equals the atmospheric pressure $P_a$ the effort exerted on the needle valve 21 is zero, valve member 13 is closed and prevents the compressed gas from flowing into the adjustment chamber 6. On the other hand, if the needle valve 21 closes completely the orifice 19, the monitoring pressure $P_2$ equals the inlet pressure $P_1$ and also the working pressure $P_3$, and the regulating piston 4 closes completely the gas exhaust orifice 16.

In the alternate form of embodiment of the invention which is illustrated in FIG. 2, the same elements as those included in the construction of FIG. 1 are designated by the same reference numerals.

In this case the amplifying chamber 7 communicates directly with the source of compressed gas 5 through a conduit 24 opening into the chamber 7 through an orifice 25 of relatively small cross-sectional passage area. On the other hand, the adjustment chamber 6 communicates directly with the atmosphere through an orifice 26 of a certain cross-sectional dimension.

As will be seen in the Figure, the rod 14 of regulating piston 4 is not provided with a longitudinal passage 17 as in the case of FIG. 1. On the other hand, the exhaust chamber 20 is also dispensed with.

Preferably, the orifice through which the compressed gas flows into the amplifying chamber 7 is not aligned with the outlet orifice 19, as shown in the case of the orifice 25 formed through the lateral wall of bore 3.

If the compressed gas is introduced into the amplifying chamber 7 through the piston rod 14 (as in the case illustrated in FIG. 1), a transverse partition may be provided in chamber 7, with a solid portion between the inlet orifice 18 and the outlet orifice 19, and one or several holes staggered in the transverse direction to avoid any alignment thereof with the outlet orifice 19.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What I claim is:

1. A device for controlling a pneumatic actuator comprising a working piston, a working chamber in which a pressure varying as a function of the effort to be exerted by said working piston is to be produced, a body, a cylindrical bore formed in said body, a regulating piston slidably fitted in said cylindrical bore, a rod rigid with said piston which emerges from said bore, an adjustment chamber and an amplifying chamber formed in said cylindrical bore on either side of said regulating piston, said adjustment chamber communicating with said working chamber, an inlet chamber formed in said body, a source of compressed gas delivering said gas under a constant pressure, said source being connected permanently to said inlet chamber, a first orifice connecting said inlet chamber to said adjustment chamber, a valve member carried by the rod of said regulating piston and closing said first orifice, another orifice of relatively small cross-sectional area connecting said amplifying chamber to said source of compressed gas, a third orifice having a greater cross-sectional area than said second orifice which connects said amplifying chamber to the surrounding atmosphere, a valve member adapted to obturate said third orifice and a control device acting upon said valve member in order to vary the free cross-sectional passage area of said third outlet orifice and to adjust in proportion thereto the pressure prevailing in said amplifying chamber and, therefore, the pressure in said adjustment chamber and in the working chamber of said pneumatic actuator.

2. A device as set forth in claim 1, comprising a longitudinal conduit formed in the rod of said regulating piston to provide a direct communication between said inlet chamber and said amplifying chamber.

3. A device as set forth in claim 1, comprising an exhaust chamber communicating permanently with said working chamber of said pneumatic actuator, an exhaust orifice connecting said exhaust chamber to the surrounding atmosphere and another valve member rigid with the rod of said regulating piston and closing said exhaust orifice when said first valve member opens the orifice connecting said inlet chamber to said adjustment chamber.

4. A device as set forth in claim 1, comprising a conduit disposed externally of said body and connecting said amplifying chamber to said source of compressed gas and opening into said amplifying chamber through said other orifice.

5. A device as set forth in claim 1, comprising a fourth orifice through which said adjustment chamber communicates directly with the surrounding atmosphere.

* * * * *